US007940243B2

(12) United States Patent
Woo et al.

(10) Patent No.: US 7,940,243 B2
(45) Date of Patent: May 10, 2011

(54) INTEGRATED CIRCUIT DEVICES HAVING A DATA CONTROLLED AMPLIFIER AND METHODS OF OPERATING THE SAME

(75) Inventors: Jae Hyuck Woo, Gyeonggi-do (KR); Jae Goo Lee, Gyeonggi-do (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 498 days.

(21) Appl. No.: 11/270,916

(22) Filed: Nov. 10, 2005

(65) Prior Publication Data

US 2006/0132410 A1 Jun. 22, 2006

(30) Foreign Application Priority Data

Dec. 21, 2004 (KR) ..... 2004-0109284

(51) Int. Cl.
*G09G 3/36* (2006.01)

(52) U.S. Cl. ..... 345/100; 365/207; 330/252

(58) Field of Classification Search ..... 345/52, 345/87, 98–100, 204; 341/144; 365/198.011, 365/207, 189.011; 330/252; 327/28
See application file for complete search history.

(56) References Cited

U.S. PATENT DOCUMENTS

| | | | | |
|---|---|---|---|---|
| 5,311,145 | A | 5/1994 | Huijsing et al. | |
| 5,745,007 | A | 4/1998 | Redman-White | |
| 6,252,534 | B1 * | 6/2001 | Timko | 341/154 |
| 7,006,114 | B2 * | 2/2006 | Sakaguchi | 345/690 |
| 2002/0060657 | A1 * | 5/2002 | Matsueda et al. | 345/89 |
| 2003/0137526 | A1 * | 7/2003 | Sakaguchi | 345/690 |
| 2005/0040889 | A1 * | 2/2005 | Tsuchi | 330/255 |

FOREIGN PATENT DOCUMENTS

| | | |
|---|---|---|
| CN | 1434431 | 8/2003 |
| CN | 1222979 | 7/2004 |
| KR | 1020030063206 A | 7/2003 |

OTHER PUBLICATIONS

Notice to Submit Response in Korean Application No. 10-2004-0109284; Date of mailing May 23, 2006.
Translation of Notice to Submit Response in Korean Application No. 10-2004-0109284; Date of mailing May 23, 2006.
Second Office Action in Chinese Application No. 200510125393; Date of mailing May 22, 2009.

* cited by examiner

*Primary Examiner* — Amr Awad
*Assistant Examiner* — Liliana Cerullo
(74) *Attorney, Agent, or Firm* — Myers Bigel Sibley & Sajovec, P.A.

(57) ABSTRACT

An integrated circuit device includes an amplifier circuit that includes first and second differential transistor pairs that are selectively operable responsive to at least one bit of a multi-bit data signal.

14 Claims, 8 Drawing Sheets

Prior Art

Prior Art

Prior Art

Prior Art

INTEGRATED CIRCUIT DEVICES HAVING A DATA CONTROLLED AMPLIFIER AND METHODS OF OPERATING THE SAME

RELATED APPLICATION

This application claims the benefit of and priority to Korean Patent Application No. 2004-0109284, filed Dec. 21, 2004, the disclosure of which is hereby incorporated herein by reference.

FIELD OF THE INVENTION

The present invention relates generally to integrated circuit devices and methods of operating the same and, more particularly, to display devices and methods of operating the same.

BACKGROUND OF THE INVENTION

A source driver circuit for a Thin Film Transistor-Liquid Crystal Display (TFT-LCD) applies a gradation voltage, e.g., gray scale voltage, corresponding to display data to a display panel through a source line. For example, when a gate driver turns on a switch, the source driver applies the gradation voltage to a liquid crystal capacitor that is connected to the switch. FIG. 1 illustrates a conventional source driver 100, which includes a decoder 110 and an amplifier 120. The decoder receives the gray scale voltages (VGRAY) and outputs a gray scale voltage D_VOL based on the display data D. If the display data D is n bits, then the gray scale voltages VGRAY comprise $2^n$ different voltage levels between a source voltage and a common or ground voltage. The amplifier 120 amplifies the selected gray scale voltage D_VOL and applies an amplifier gray scale voltage VOUT to a display panel.

FIG. 2 is a schematic of an input portion of the amplifier 120 of FIG. 1. The gray scale voltage D_VOL is applied as an input to the gates of transistors NTR1 and PTR1. Based on the level of the gray scale voltage D_VOL, either one of NTR1 and PTR1 is turned on or both NTR1 and PTR1 are turned on. An output driving voltage VOUT is generated at the output node NOUT and is fedback into the gates of NTR2 and PTR2.

FIG. 3 illustrates the regions of operation for transistors NTR1 and PTR1. In operation region C, VSS<D_VOL<Vth of PTR1. In this case, PTR1 is turned on, NTR1 is turned off, IS1 operates, and IS2 does not operate. In operation region B, Vth of PTR1<D_VOL<Vth of NTR1. In this case, PTR1 is turned on, NTR1 is turned on, IS1 operates, and IS2 operates. In operation region A, Vth of NTR1<D_VOL<VDD. In this case, NTR1 is turned on, PTR1 is turned off, IS2 operates, and IS1 does not operate.

FIG. 4 illustrates current consumption based on the particular operation region for transistors NTR1 and PTR1. Region 1 represents the current consumption when the gray scale voltage D_VOL is in region C of FIG. 3. Region 2 represents the current consumption when the gray voltage D_VOL is in region B of FIG. 3. Region 3 represents the current consumption when the gray voltage D_VOL is in region A of FIG. 3. Unfortunately, if the voltage level of the gray scale voltage D_VOL is in region 2 (region B of FIG. 3), the current consumption is about twice that of regions 1 and 3 (regions C and A of FIG. 3).

SUMMARY OF THE INVENTION

According to some embodiments of the present invention, an integrated circuit device includes an amplifier circuit that includes first and second differential transistor pairs that are selectively operable responsive to at least one bit of a multi-bit data signal.

In other embodiments of the present invention, the first and second differential transistor pairs are coupled to first and second switches, respectively. The first and second switches are responsive to the at least one bit of the multi-bit data signal.

In still other embodiments of the present invention, the integrated circuit device is a TFT LCD driver circuit and the amplifier circuit is responsive to a gray scale input voltage.

In still other embodiments of the present invention, a decoder is configured to select the gray scale input voltage responsive to the multi-bit data signal.

In still other embodiments of the present invention, the integrated circuit device is a TFT LCD driver circuit and the first differential transistor pair is responsive to a first gray scale input voltage and the second differential transistor pair is responsive to a second gray scale input voltage.

In still other embodiments of the present invention, a first decoder is configured to select the first gray scale input voltage responsive to at least one other bit of the multi-bit data signal. A second decoder is configured to select the second gray scale input voltage responsive to the at least one other bit of the multi-bit data signal.

According to some embodiments of the present invention, a decoding circuit for a TFT LCD driver circuit includes a first decoder that is configured to select a first gray scale voltage from n gray scale voltages responsive to m bits of a multi-bit data signal. A second decoder is configured to select a second gray scale input voltage from the n gray scale voltages responsive to the m bits of the multi-bit data signal, wherein $2^m<n$.

In further embodiments of the present invention, the first decoder is connected to a first differential transistor pair, the first differential transistor pair being responsive to the first gray scale voltage, and the second decoder is connected to a second differential transistor pair, the second differential transistor pair being responsive to the second gray scale voltage.

According to some embodiments of the present invention a TFT-LCD driver includes a decoder that is configured to select a gray scale input voltage responsive to a multi-bit data signal. An amplifier circuit includes first and second differential transistor pairs that are selectively operable responsive to at least one bit of the multi-bit data signal, the amplifier circuit being responsive to the gray scale input voltage.

In other embodiments of the present invention, the first differential transistor pair is responsive to a first gray scale input voltage and the second differential transistor pair is responsive to a second gray scale input voltage.

In still other embodiments of the present invention, a first decoder is configured to select the first gray scale input voltage responsive to at least one other bit of the multi-bit data signal. A second decoder is configured to select the second gray scale input voltage responsive to the at least one other bit of the multi-bit data signal.

Although described above primarily with respect to circuit embodiments, it will be understood that the present invention is not limited to such embodiments, but may also be embodied as methods of a circuit.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION OF PREFERRED EMBODIMENTS

Figure 1:
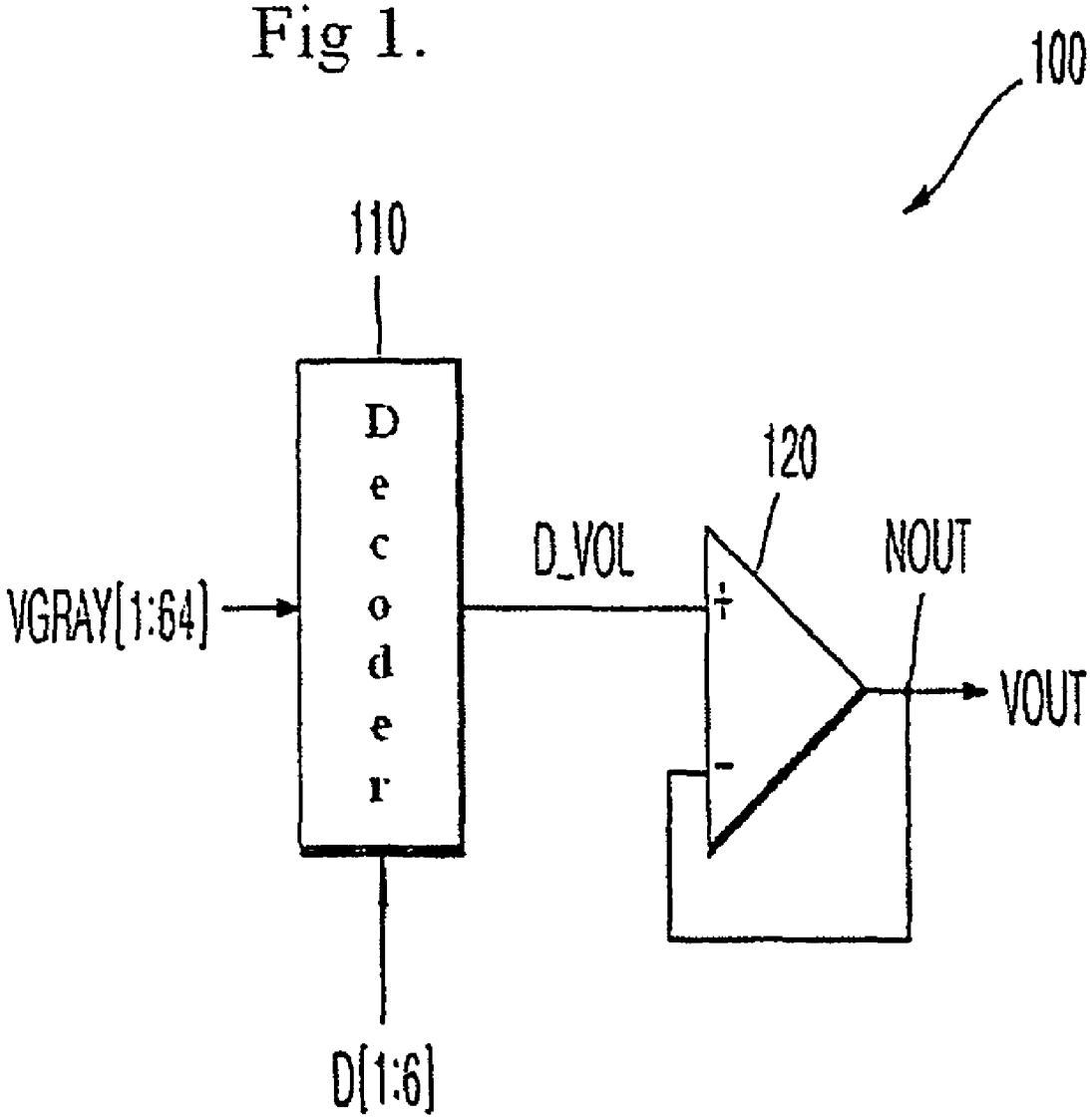
FIG. 1 is a diagram of a source driver circuit for a conventional Thin Film Transistor-Liquid Crystal Display (TFT-LCD)
Figure 2:
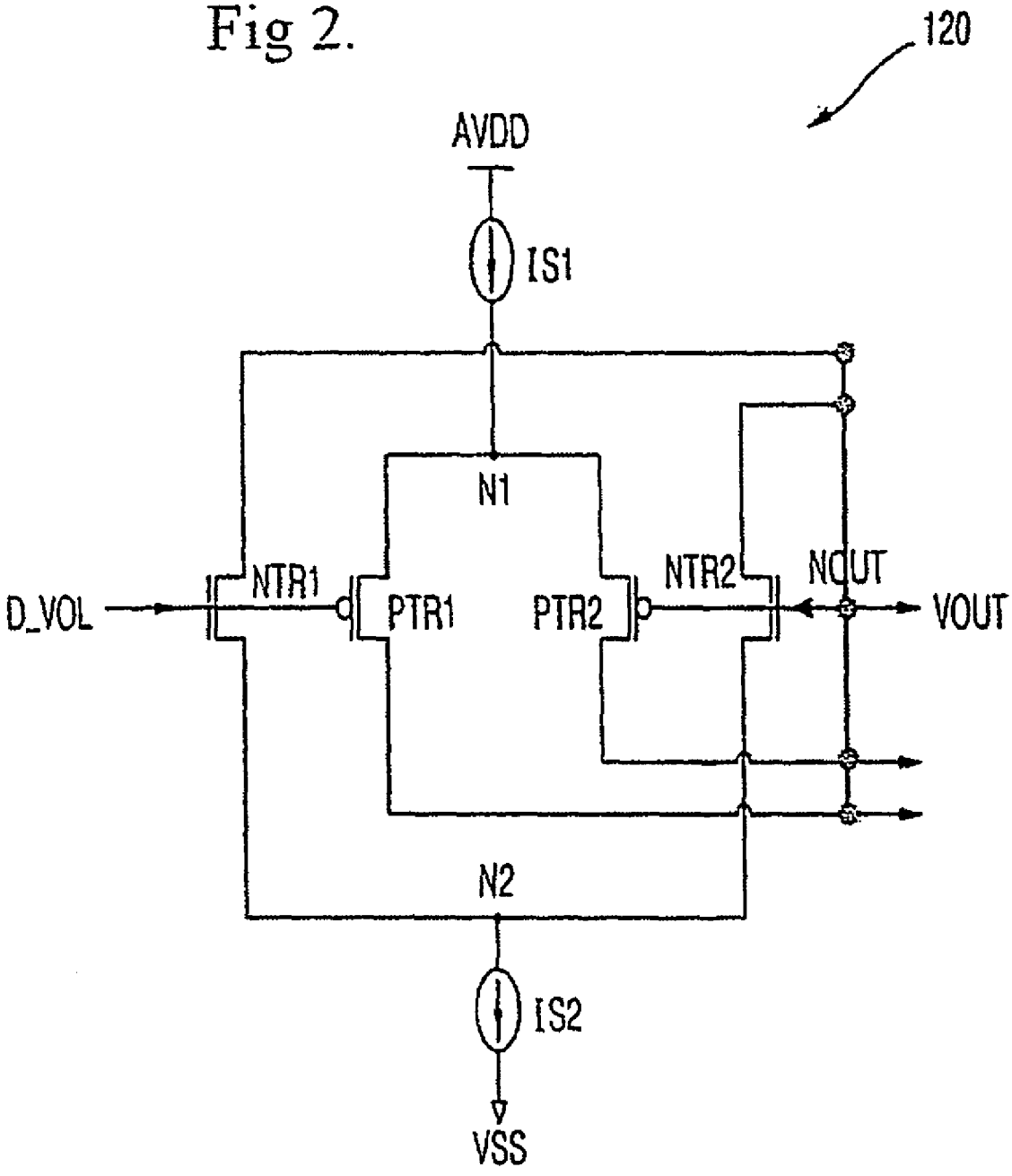
FIG. 2 is a schematic of an input portion of an amplifier of FIG. 1.
Figure 3:
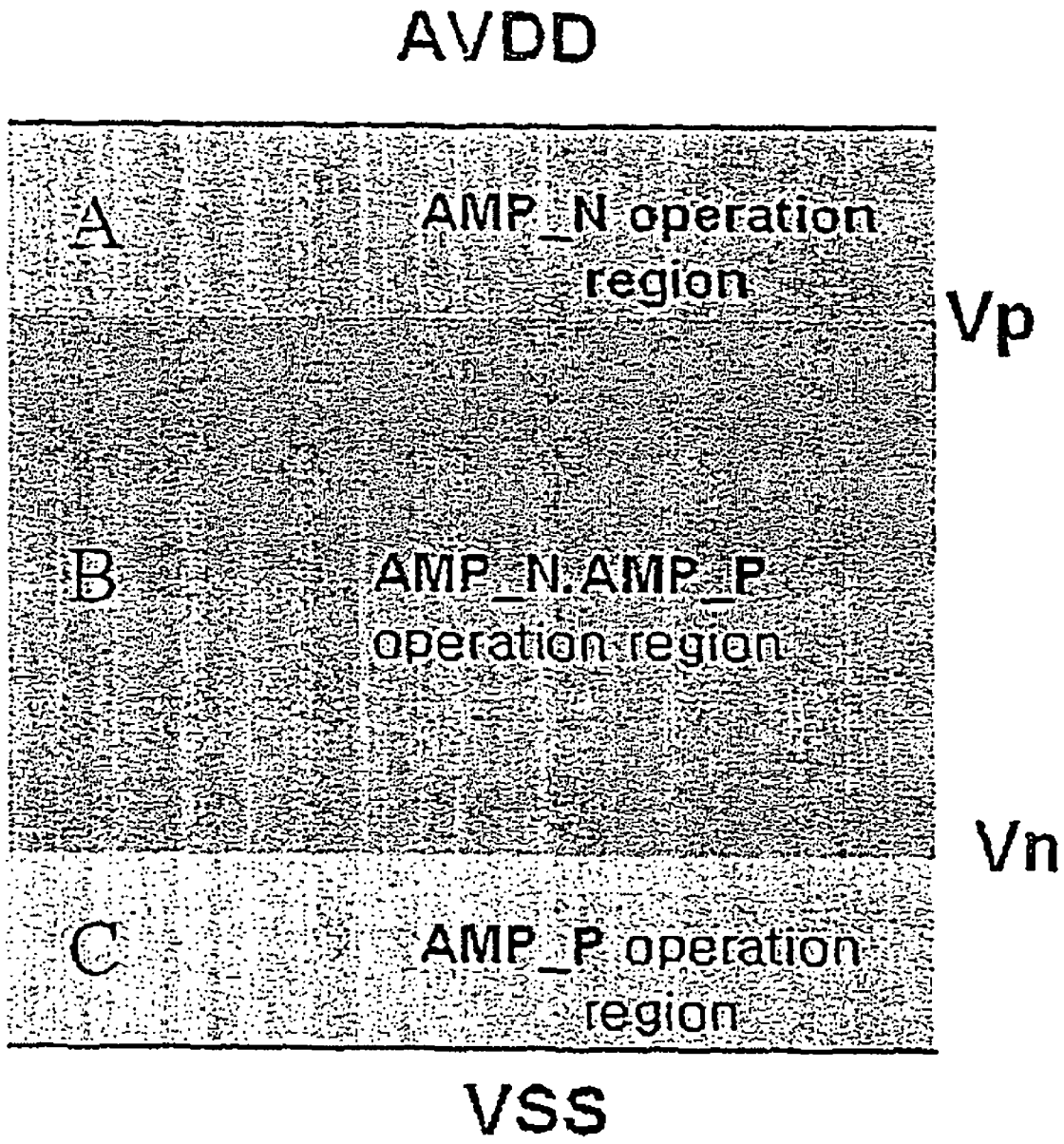
FIG. 3 illustrates the regions of operation for transistors of the amplifier of FIGS. 1 and 2.
Figure 4:
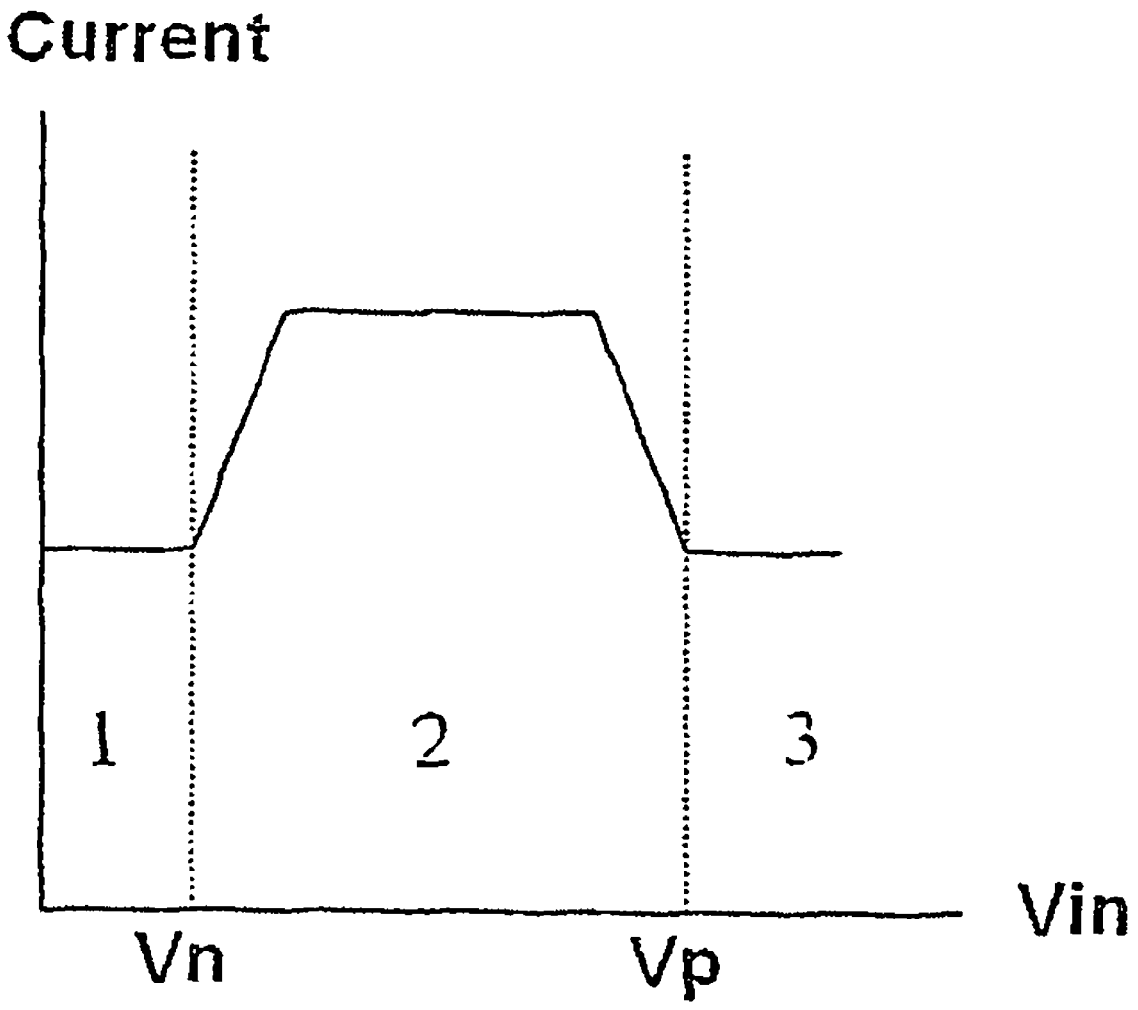
FIG. 4 illustrates current consumption based on the particular operation region for transistors of the amplifier of FIGS. 1 and 2.

While the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention as defined by the claims. Like reference numbers signify like elements throughout the description of the figures.

As used herein, the singular forms "a," "an," and "the" are intended to include the plural forms as well, unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. Furthermore, "connected" or "coupled" as used herein may include wirelessly connected or coupled. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

For purposes of illustration, embodiments of the present invention are described herein with reference to a Thin Film Transistor-Liquid Crystal Display (TFT-LCD) driver. It will be understood that the present invention is not limited to these embodiments, but instead can be embodied as other types of integrated circuit devices and/or circuits.

Figure 5:
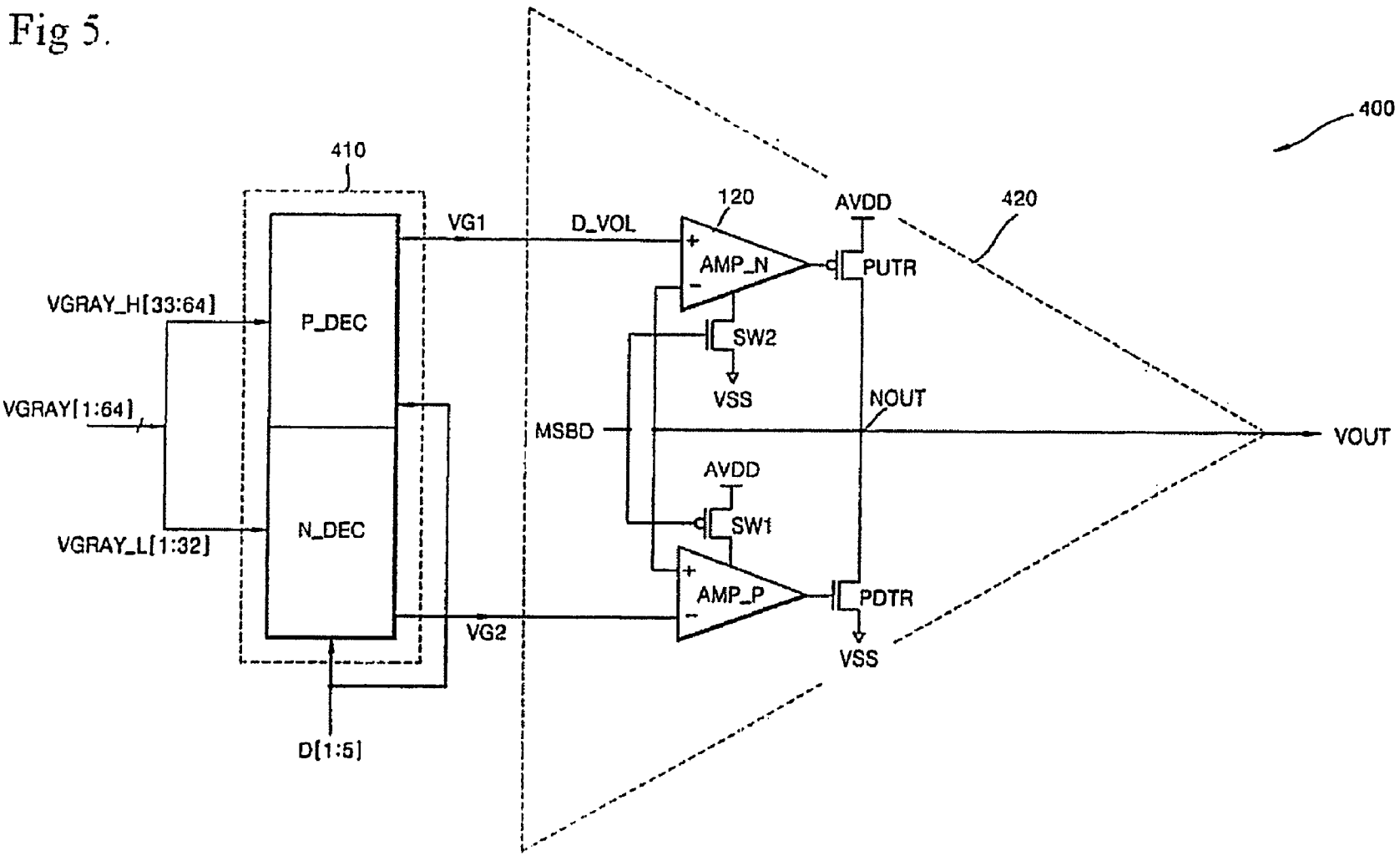
FIG. 5 is a schematic of a TFT-LCD driver circuit 400 in accordance with some embodiments of the present invention.

FIG. 5 is a schematic of a TFT-LCD driver circuit 400 in accordance with some embodiments of the present invention. The TFT-LCD driver circuit 400 comprises a decoder 410 and an amplifier 420. The decoder 410 comprises two sub-decoder circuits P_DEC and N_DEC. P_DEC is configured to output a first gray scale voltage VG1, which is selected from high gray scale voltages VGRAY_H based on the data signal D. As shown in FIG. 5, VGRAY_H comprises $2^n/2$ voltage levels and the data signal D comprises n−1 bits. N_DEC is configured to output a second gray scale voltage VG2, which is selected from low gray scale voltages VGRAY_L based on the data signal D. As shown in FIG. 5, VGRAY_L comprises $2^n/2$ voltage levels and the data signal D comprises n−1 bits.

The amplifier 420 comprises two sub-amplifier circuits AMP_N and AMP_P. The amplifier 420 outputs one of VG1 and VG2 as a display panel operating voltage responsive to a control signal MSBD, which is the most significant bit of the data signal D. The amplifier 420 is configured such that only one of the sub-amplifier circuits AMP_N and AMP_P can operate at any given time. AMP_P is connected to the source voltage AVDD through a first switch SW1 and AMP_N is connected to the ground or common voltage VSS through a second switch SW2. The output node NOUT is driven to the VOUT voltage level by using pull-up transistor PUTR and pull down transistor PDTR.

Figure 6:
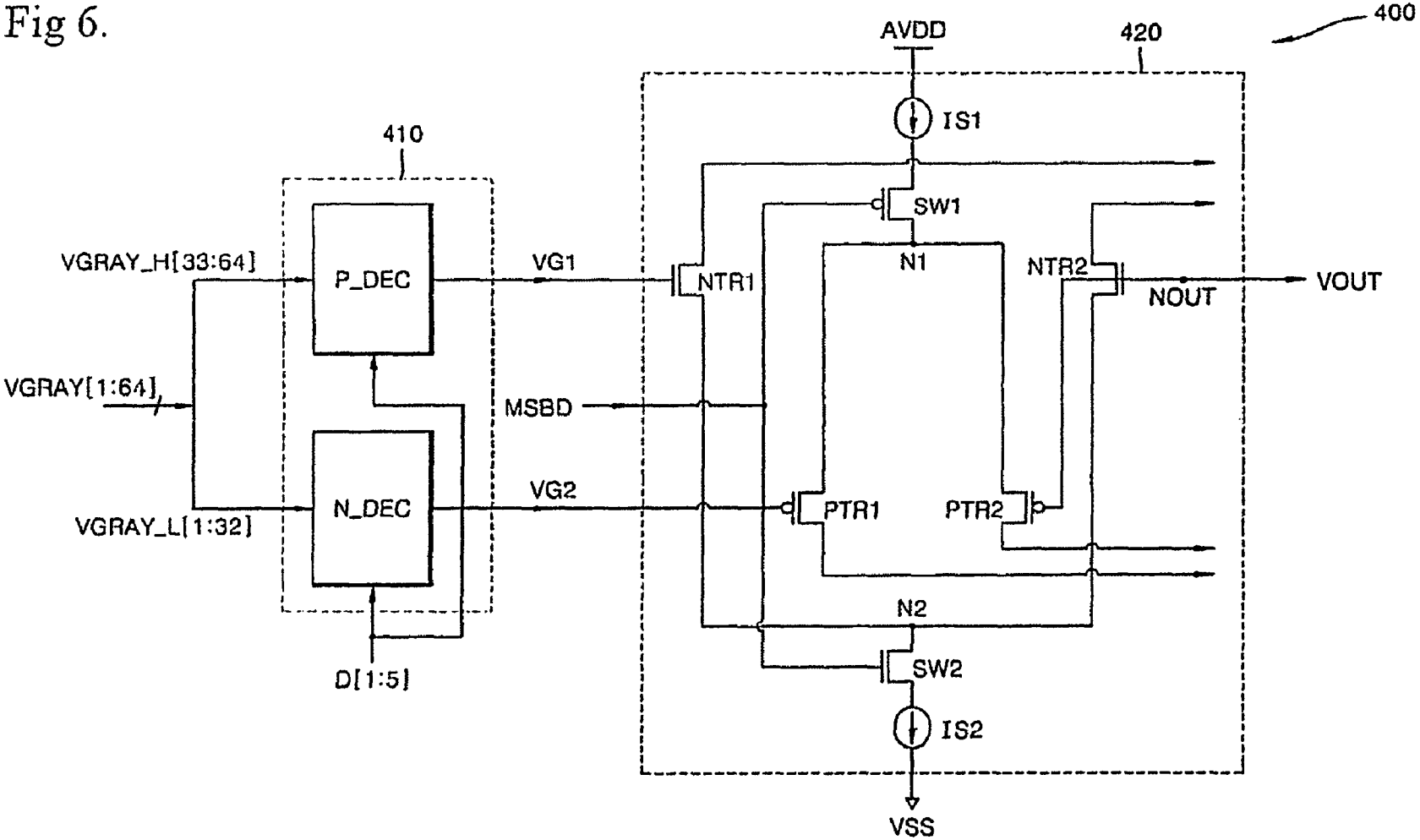
FIG. 6 is a schematic of an input portion of the amplifier of FIG. 5 in accordance with some embodiments of the present invention.

FIG. 6 is a schematic of an input portion of the amplifier 420 of FIG. 5. The amplifier 420 comprises an input portion that receives the voltages VG1 and VG2 and an output portion (not shown) that amplifies an output from the input portion and outputs a display panel operating voltage VOUT through the output node NOUT in response to the control signal MSBD. The input part of the amplifier 420 comprises transistors PTR1 and PTR2 (AMP_P), transistors NTR1 and NTR2 (AMP_N), switches SW1 and SW2, and current sources IS1 and IS2, which are connected as shown.

Figure 7:
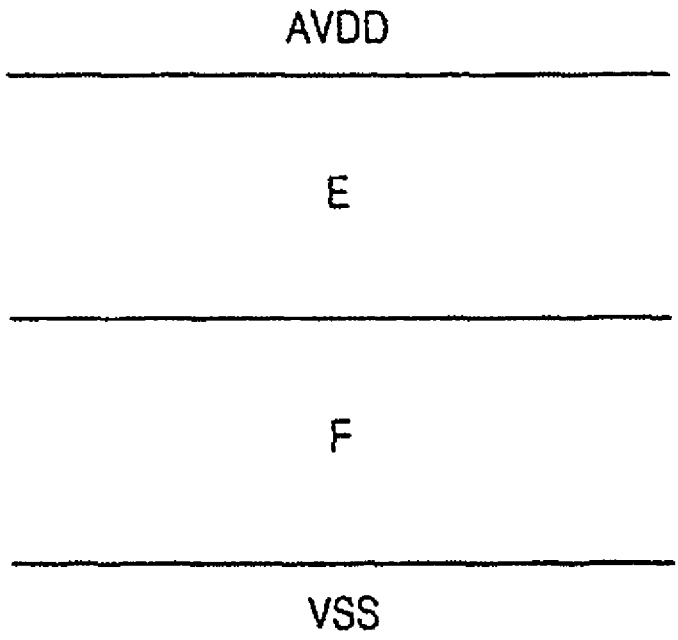
FIG. 7 illustrates regions of operation for transistors of the amplifier of FIGS. 5 and 6.

As shown in FIG. 7, transistor NTR1 operates in an E region and transistor PTR1 operates in an F region between VSS and AVDD. Thus, according to some embodiments of the present invention, NTR1 and PTR1 are not on at the same time.

Figure 8:
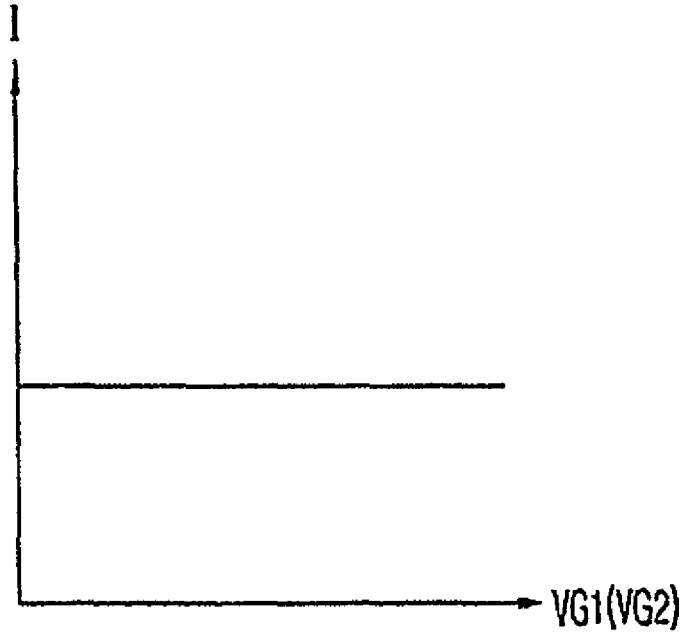
FIG. 8 illustrates current consumption of the amplifier of FIGS. 5 and 6.

FIG. 8 shows that the current consumption of the amplifier 420 is approximately constant. Advantageously, a capacitance that is connected to an output part of the amplifier 420 for compensating for the frequency of the amplifier 420 can be relatively small.

Figure 9:
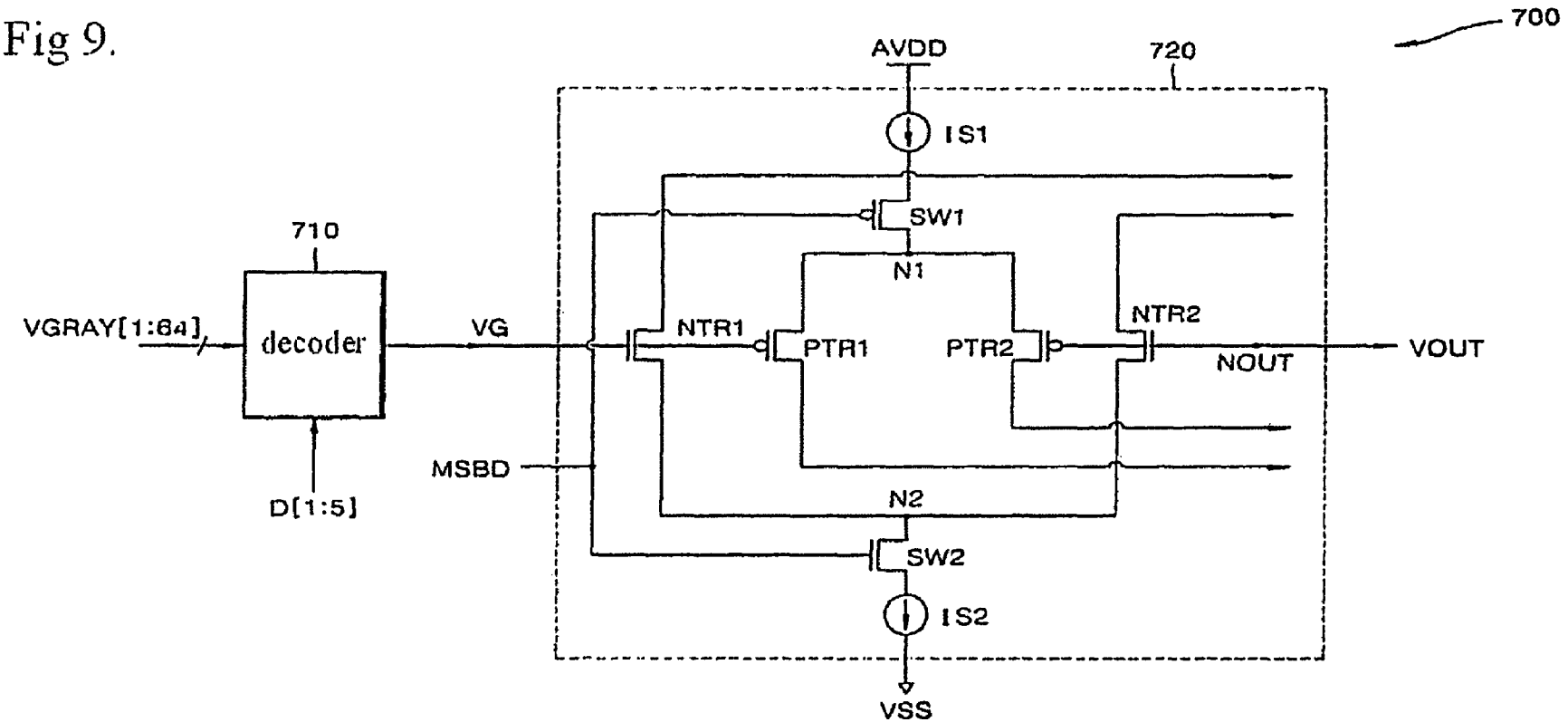
FIG. 9 is a schematic of a TFT-LCD driver circuit in accordance with further embodiments of the present invention.

FIG. 9 is a schematic of a TFT-LCD driver circuit 700 in accordance with some embodiments of the present invention. The TFT-LCD driver circuit 700 comprises a decoder 710 and an amplifier 720. The amplifier 720 comprises the same components as the amplifier 420 of FIGS. 5 and 6. The amplifier 720, however, is configured such that a common output voltage VG drives the transistors NTR1, PTR1 from the decoder 710. The transistors pairs NTR1, NTR2, and PTR1, PTR2 are selectively operable, however, in response to the MSBD signal, which, according to some embodiments of the present invention, is the most significant bit of the n-bit data signal D. In contrast to the embodiments of FIGS. 5 and 6, the decoder 710 outputs a single gray scale voltage VG in response to a selection of one of the $2^n$ gray scale voltages VGRAY based on the n-bit data signal D.

In concluding the detailed description, it should be noted that many variations and modifications can be made to the preferred embodiments without substantially departing from the principles of the present invention. All such variations and modifications are intended to be included herein within the scope of the present invention, as set forth in the following claims.

That which is claimed:

1. An integrated circuit device, comprising:

a first decoder that is configured to select a first gray scale input voltage responsive to at least one bit of a multi-bit data signal;

a second decoder that is configured to select a second gray scale input voltage responsive to the at least one bit of the multi-bit data signal; and an amplifier circuit with a single pull-up transistor, a single pull-down transistor, a first sub amplifier, and a second sub amplifier, the first and second sub amplifiers being selectively operable responsive to at least one other bit of the multi-bit data signal;

wherein the first sub amplifier has a first input terminal connected to the first gray scale input voltage, a second input terminal connected to a common node of the pull-up and pull-down transistors, and an output terminal directly connected to a gate of the pull-up transistor;

the second sub amplifier has a first input terminal connected to the second gray scale input voltage, a second input terminal connected to the common node of the pull-up and pull-down transistors, and an output terminal directly connected to a gate of the pull-down transistor; and wherein the first and second decoders are not responsive to the at least one other bit of the multi-bit data signal.

2. The integrated circuit device of claim 1, wherein the first and second sub amplifiers are coupled to first and second switches, respectively, the first and second switches being responsive to the at least one other bit of the multi-bit data signal.

3. The integrated circuit device of claim 1, wherein the at least one other bit of the multi-bit data signal is a Most Significant Bit (MSB) of the multi-bit data signal.

4. The integrated circuit device of claim 1, wherein the integrated circuit device is a TFT LCD driver circuit.

5. A TFT-LCD driver, comprising:

a decoder that is configured to select first and second gray scale input voltages responsive to a first portion of a multi-bit data signal; and an amplifier circuit with a single pull-up transistor, a single pull-down transistor a first sub amplifier, and a second sub amplifier, the first and second sub amplifiers being selectively operable responsive to a second portion of the multi-bit data signal, the amplifier circuit being responsive to the first and second gray scale input voltages;

wherein the first sub amplifier has a first input terminal connected to the first gray scale input voltage, a second input terminal connected to a common node of the pull-up and pull-down transistors, and an output terminal directly connected to a gate of the pull-up transistor; the second sub amplifier has a first input terminal connected to the second gray scale input voltage, a second input terminal connected to the common node of the pull-up and pull-down transistors, and an output terminal directly connected to a gate of the pull-down transistor; and wherein the first portion of the multi-bit data signal and the second portion of the multi-bit data signal are mutually exclusive.

6. The TFT-LCD driver of claim 5, wherein the first and second sub amplifiers are coupled to first and second switches, respectively, the first and second switches being responsive to the second portion of the multi-bit data signal.

7. The TFT-LCD driver of claim 6, wherein the decoder further comprises:

a first decoder that is configured to select the first gray scale input voltage responsive to the first portion of the multi-bit data signal; and a second decoder that is configured to select the second gray scale input voltage responsive to the first portion of the multi-bit data signal.

8. The TFT-LCD driver of claim 5, wherein the second portion of the multi-bit data signal is a Most Significant Bit (MSB) of the multi-bit data signal.

9. A method of operating an integrated circuit device, comprising:

selecting a first gray scale input voltage responsive to at least one bit of the multi-bit data signal;

selecting a second gray scale input voltage responsive to the at least one bit of the multi-bit data signal;

selectively operating first and second sub amplifiers of an amplifier circuit responsive to at least one other bit of the multi-bit data signal, the first and second sub amplifiers being coupled to a single pull-up transistor and a single pull-down transistor, respectively, wherein the first sub amplifier has a first input terminal connected to the first gray scale input voltage, a second input terminal connected to a common node of the pull-up and pull-down transistors, and an output terminal directly connected to a gate of the pull-up transistor; the second sub amplifier has a first input terminal connected to the second gray scale input voltage, a second input terminal connected to the common node of the pull-up and pull-down transistors, and an output terminal directly connected to a gate of the pull-down transistor; and wherein the first and second gray scale input voltages are selected independently of the at least one other bit of the multi-bit data signal.

10. The method of claim 9, wherein selectively operating the pull-up and pull-down transistor pairs comprises selectively operating first and second switches that are coupled to the first and second sub amplifiers, respectively, responsive to the at least one other bit of the multi-bit data signal.

11. The method of claim 9, wherein the at least one other bit of the multi-bit data signal is a Most Significant Bit (MSB) of the multi-bit data signal.

12. The method of claim 9, wherein the integrated circuit device is a TFT LCD driver circuit.

13. A method of operating TFT-LCD driver, comprising:

selecting a first and second gray scale input voltages responsive to a first portion of a multi-bit data signal; and selectively operating first and second sub amplifiers of an amplifier circuit responsive to a second portion of the multi-bit data signal, the first and second sub amplifiers being coupled to a single pull-up transistor and a single pull-down transistor, respectively, the amplifier circuit being responsive to the first and second gray scale input voltages wherein the first sub amplifier has a first input terminal connected to the first gray scale input voltage, a second input terminal connected to a common node of the pull-up and pull-down transistors, and an output terminal directly connected to a gate of the pull-up transistor; and the second sub amplifier has a first input terminal connected to the second gray scale input voltage, a second input terminal connected to the common node of the pull-up and pull-down transistors, and an output terminal directly connected to a gate of the pull-down transistor;

wherein the first portion of the multi-bit data signal and the second portion of the multi-bit data signal are mutually exclusive.

14. The method of claim 13, wherein the second portion of the multi-bit data signal is a Most Significant Bit (MSB) of the multi-bit data signal.

* * * * *